United States Patent [19]

Beyer et al.

[11] Patent Number: 4,563,961

[45] Date of Patent: Jan. 14, 1986

[54] TUFTING NEEDLE

[75] Inventors: Walter Beyer, Eschweiler; Joachim Beyer, Aachen, both of Fed. Rep. of Germany

[73] Assignee: Jos. Zimmerman, Aachen, Fed. Rep. of Germany

[21] Appl. No.: 611,887

[22] Filed: May 18, 1984

[30] Foreign Application Priority Data

May 21, 1983 [DE] Fed. Rep. of Germany ..... 8315049

[51] Int. Cl.[4] ..... D05B 85/00

[52] U.S. Cl. ..... 112/222

[58] Field of Search ..... 112/222, 223

[56] References Cited

U.S. PATENT DOCUMENTS 228,446 6/1880 Cross ..... 112/222

3,469,548 9/1969 Zocher ..... 112/222

3,929,082 12/1975 Zocher ..... 112/222

3,954,072 5/1976 Zocher ..... 112/222

*Primary Examiner*—Ronald Feldbaum

*Attorney, Agent, or Firm*—Lalos, Keegan, Marsh, Bentzen & Kaye

[57] ABSTRACT

In a tufting needle with an eye (7) elongate in the direction of the needle axis (8), one side face is bevelled at one longitudinal edge by a land (6) and at the other longitudinal edge by a bias grind (14) reaching into the zone of the eye. The uppermost zone of that edge (9) of the eye, which zone is furthest from the needle point (13), is offset towards the land (6) relatively to the central axis (8) of the eye (7) to facilitate trouble-free co-operation between the looper (2) on the one hand and the needle and yarn (5) on the other hand.

3 Claims, 6 Drawing Figures

TUFTING NEEDLE

DESCRIPTION

The invention relates to a tufting needle of which the shank adjoining a ram is flat, has a yarn groove and is provided near its point with an eye which is elongate in the direction of the needle axis and at the end remote from the point has a curved upper edge, one side face of the shank being bevelled towards one of its longitudinal edges by a land and towards its other longitudinal edge by a bias grind reaching into the zone of the eye.

Such tufting needles are either individually fixed at the desired pitch to a needle bar or are combined with a plurality of like needles to form needle modules which are in turn fixed to the needle bar.

When using such a tufting needle, it is pushed through a basic fabric, the yarn that is to be processed extending through the eye of the needle. After piercing the basic fabric, a looper executes a movement substantially transversely to the needle axis to engage in the region between a side face of the needle and the associated yarn so as to retain the yarn during return motion of the needle and thereby form loops which can subsequently be cut open depending on the nature of the desired product.

The looper associated with each needle is swung in transversely while the needle is still moving downwardly, the land provided on the needle helping to keep wear as low as possible during co-operation of the looper and needle. During the subsequent upward motion of the needle, the looper slides off by way of the bias grind in the region of the eye. During co-operation of the needle and looper upon retraction of the needle, the grind serves to avoid raised portions in the needle that might result in jumping of the looper and impact stresses. Especially during piercing of the needle through the basic fabric and during further downward movement, a considerable tensile force is exerted parallel to the needle axis on the yarn disposed in the eye of the needle. This tensile force causes the yarn in the sphere of influence of the looper to be displaced rearwardly and partly into the path of the looper because of the obliqueness of the bias grind in the direction of the looper movement. This can result in the looper failing to be disposed between the needle and yarn but dividing the yarn. Consequently, only a part of the yarn will then be properly slung about the looper whereas the other part of the yarn will not be held back by the looper as the needle is retracted. As a result, there will be unacceptable faults in the tufted goods.

The present invention aims to provide a tufting needle in which such errors are avoided even in the case of particularly fast tufting machines.

In a tufting needle of the aforementioned kind, the invention provides that the zone of the upper edge of the eye, which zone is furthest from the point, is offset towards the land relatively to the central axis of the eye.

Construction of the eye in accordance with this invention ensures that, during co-operation of the needle and looper, at least the greater part of the yarn disposed in the eye will not lie in the region of the bias grind. Consequently, the yarn cannot be displaced towards the looper when loaded in tension.

The construction of the tufting needle according to the invention may be such that the zone of the upper edge of the eye, which zone is furthest from the point, is offset towards the land relatively to the central axis of the eye by 10 to 35% of the width of the eye.

The optimum construction of the eye of the needle as far as its upper edge is concerned depends primarily on the yarn to be used.

According to the invention, the tufting needle may be constructed so that the zone of the upper edge of the eye, which zone is furthest from the point, is offset towards the land relatively to the central axis of the eye by 20% of the width of the eye.

The resulting construction of the upper edge of the eye has been found by experiment to be the optimum for many current types of yarn.

One embodiment of tufting needle according to the invention will now be described with reference to the drawings, wherein.

Figure 2:
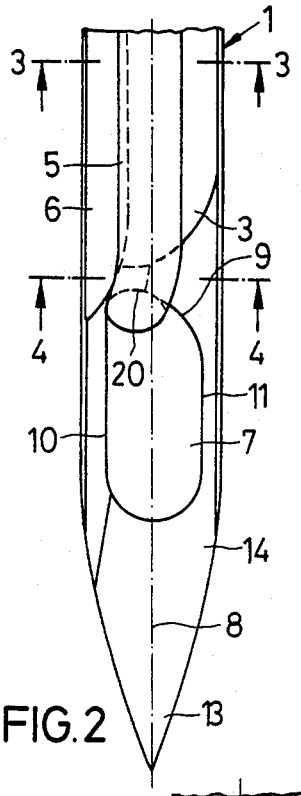
FIG. 2 is a view similar to FIG. 1 of a tufting needle according to the invention.
Figure 1:
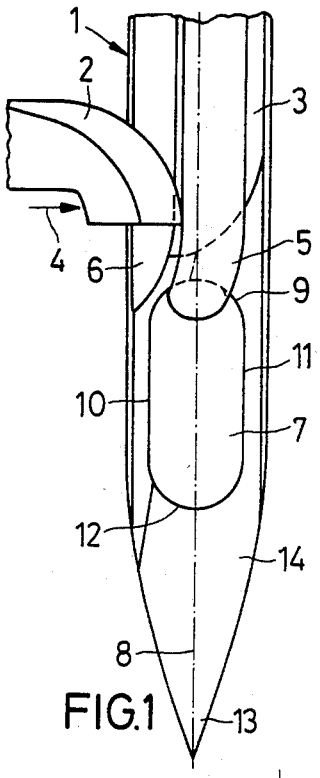
FIG. 1 is a side elevation of the lower shank portion of a conventional tufting needle with yarn and looper.
Figure 3:
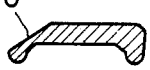
FIG. 3 is a section on the line 3—3 in FIG. 2.
Figure 4:
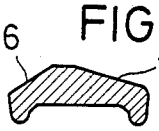
FIG. 4 is a section on the line 4—4 in FIG. 2.
Figure 6:
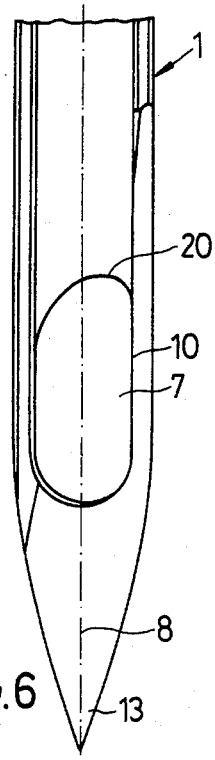
FIG. 6 is an elevation of the side of the tufting needle opposite to the surface shown in FIG. 2.
Figure 5:
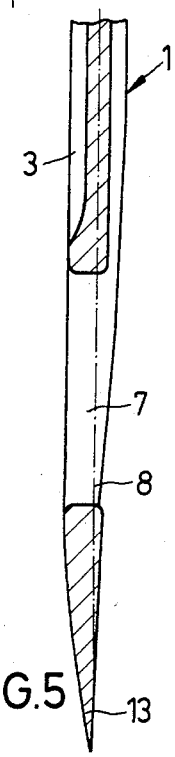
FIG. 5 is a longitudinal section through the needle.

The tufting needle according to FIG. 1 has a shank 1 with a hollow throat 3 in the region where the needle co-operates with a looper 2. During downward motion of the needle, the looper 2 moves in the direction of the arrow 4 and then comes to lie between the shank 1 of the needle and a yarn 5. The hollow throat 3 is preceded by a land 6. This land 6 ensures that the side face of the needle shown in FIG. 1 rises slightly as viewed in the direction of motion of the looper 2.

The shank 1 of the needle is also provided with an eye 7 which extends along the needle axis 8 and is symmetrical thereto. The eye 7 has an upper curved edge 9, a front edge 10, a rear edge 11 and a lower edge 12. The spacing between the front edge 10 and rear edge 11 corresponds to the width of the eye.

The shank 1 terminates in a needle point 13.

In the region of the eye 7 and needle point 13, there is a bias grind 14 which defines an oblique face that drops off from the zone of the eye towards the rear longitudinal edge of the needle. This bias grind 14 ensures that the looper 2 is slidingly guided in the region of the needle point 13 out of the hollow throat 3 during upward motion of the needle without any jumps or impacts. The inclination of this bias grind substantially balances out the oblique position of the needle side face to the looper 2 caused by twisting of the needle. However, twisting and bias grind are known constructions for such needles and not the subject of the invention.

The embodiment described in FIGS. 2 to 6 corresponds to the previously described known tufting needle with the exception of the upper edge 9 of the eye. It is therefore not necessary to describe FIGS. 2 to 6 in detail, where the same reference numerals are used as in FIG. 1.

The upper edge 9 of the eye in the embodiment according to the invention is no longer symmetrical to the needle axis 8. This upper edge 9 is curved as before but has its highest point or its zone 20 furthest from the point 13 out of the centre, namely displaced towards the front edge 10 or also in the direction of the land 6. Such offsetting amounts to 20% in the illustrated example, i.e. the zone 20 is offset by 20% of the width of the eye towards the front edge 10 or the land 6. Accordingly, the yarn will likewise be offset in the same direction by 20% of the width of the eye. This means that the yarn 5 will for the most part no longer lie over the bias grind 14 which, in the previously described known tufting needle, enables the yarn to become displaced towards the looper 2. The exclusion of such displacement prevents the yarn from coming into the path of the looper and being divided thereby.

It has been found that, particularly depending on the yarn to be used, displacement of the zone 20 should preferably be in the region of 10 to 35% of the width of the eye.

The tufting needle as here proposed can be individually connected to a bar or combined into modules.

In other respects, the needle may have any desired ram construction, in particular a round or flat ram. Oval ram constructions are also possible.

We claim:

1. A tufting needle of which the shank adjoining a ram is flat, has a yarn groove and is provided near its point with an eye which is elongate in the direction of the needle axis and at the end remote from the point has a curved upper edge, one side face of the shank being bevelled towards one of its longitudinal edges by a land and towards its other longitudinal edge by a bias grind reaching into the eye zone, characterised in that the zone of the upper eye edge (9), which zone is furthest from the point (13), is asymmetrically offset only towards the land (6) relatively to the central axis (8) of the eye (7).

2. A tufting needle according to claim 1, characterised in that the zone (20) of the upper edge (9) of the eye, which zone is furthest from the point (13), is offset towards the land (6) relatively to the central axis (8) of the eye (7) by from 10 to 35% of the width of the eye.

3. A tufting needle according to claim 2, characterised in that the zone (20) of the upper edge (9) of the eye, which zone is furthest from the point (13), is offset towards the land (6) relatively to the central axis (8) of the eye (7) by 20% of the width of the eye.

* * * * *